US006119909A

United States Patent [19]

Dancyger

[11] Patent Number: 6,119,909

[45] Date of Patent: Sep. 19, 2000

[54] SPECIALLY CONFIGURED TOOL HOLDER

[76] Inventor: Michael Dancyger, 811 W. 58th St., Los Angeles, Calif. 90037

[21] Appl. No.: 09/378,595

[22] Filed: Aug. 20, 1999

[51] Int. Cl.[7] ..... A45C 1/04

[52] U.S. Cl. ..... 224/683; 224/681; 224/684; 224/674; 224/904

[58] Field of Search ..... 224/904, 676, 224/680, 682, 683, 684, 911; D3/224, 228

[56] References Cited

U.S. PATENT DOCUMENTS

| | | | |
|---|---|---|---|
| D. 258,248 | 2/1981 | Tillman | D3/228 |
| D. 313,121 | 12/1990 | Dise | D3/228 |
| D. 316,185 | 4/1991 | Seber | D3/228 |
| D. 348,777 | 7/1994 | Dancyger | D3/228 |
| D. 348,982 | 7/1994 | Dancyger | D3/228 |
| 3,347,299 | 10/1967 | Alexander | 224/911 X |
| 4,300,708 | 11/1981 | Patermann | 224/904 X |
| 4,356,854 | 11/1982 | McGee | 224/904 X |
| 4,796,790 | 1/1989 | Hamilton | 224/683 X |
| 5,653,337 | 8/1997 | Cirgliano | 224/904 X |

*Primary Examiner*—Gregory M Vidovich
*Attorney, Agent, or Firm*—Andra M. Vaccaro

[57] ABSTRACT

The tool holder of the present invention has one or more pockets which are specially configured to hold a variety of portable tools and other objects. Specifically, the present invention comprises a tool holder or bag that has at least one pocket configured so that it can carry a relatively heavy power tool such as a power drill, or a lighter tool having an angular portion such as a soldering gun, caulking gun and the like. In the preferred embodiment, the specially configured pocket is placed in the area closest to the user to provide additional structural support for the tool to be placed therein. Pockets can also be specially configured to contain other tools.

7 Claims, 2 Drawing Sheets

SPECIALLY CONFIGURED TOOL HOLDER

BACKGROUND OF THE INVENTION

1. Field of the Invention

The invention relates to the field of tool holders that are used by carpenters, electricians, plumbers, roofers, gardeners, students and the like who want the ability to carry many different objects at the same time while working in a convenient, easy to use, manner. More specifically, this invention relates to a specially configured tool pouch that is capable of carrying power tools.

2. Description of the Prior Art

In the prior art, numerous tool holding apparatuses have been disclosed that may be inserted or worn on a belt, attached to an apron or mounted on a carrier such as a bucket, box or carton. For example, in order to perform various tasks in their given trades, tradespersons such as electricians, carpenters and plumbers use tool holders to transport the various tools that they frequently use to each job site.

The prior art tool holders usually have one or more pockets or pouches into which small tools and other objects are placed to be carried from job to job. For example, tools, such as screwdrivers, smaller wire cutters, chisels and the like normally are stored in one or more of the larger pockets. Small objects such as nuts, bolts, nails and the like usually are placed in the smaller pockets. The holders also may contain hooks and/or loops through which a variety of tools such as hammers may be suspended.

In the prior art, tool pouches are usually made up of one or more pockets that are substantially square or rectangular in shape. The problem with these prior art pouches is that due to the way they are configured, the pockets are unable to safely contain other types of tools and other items that are often used on various jobs. For example, tools such as electric drills, electric screwdrivers and caulking guns usually do not fit easily into a pocket along with other tools and supplies. Further, to the extent that they do fit, due to the weight distribution of the tool or other item, the tool or item has a tendency to fall out of the pocket. Thus, the shape and configuration of the pockets contained within prior art tool holders limit the types of tools and other items that may be carried therein.

Therefore, there has been a long felt need for a tool holder which can easily store and transport most of the smaller power tools and other relatively large sized items that are used today. There also has been a long felt need for a tool holder that is capable of carrying angular tools or other items without the risk of those tools or items falling out of the pocket into which they have been placed.

The present invention overcomes the disadvantages of prior art tool holders since there is at least one or more specially shaped pockets that allows the user to carry a variety of power tools or other large items that they have not been able to easily carry on or in their tool holders in the past. Due to the new and novel configuration of at least one or more of the pockets, there is less danger that a larger tool or other item such as a power drill and the like will fall out of the tool holder thereby injuring the user or the surface nearby.

SUMMARY OF INVENTION

The present invention relates to tool holders usually used on work belts, aprons, bucket carriers and the like. The tool holder of the present invention has one or more pockets which are specially configured to hold a variety of power tools and other objects including those that have an angular portion comprising a part thereof.

The present invention comprises a tool holder or bag that has at least one pocket configured so that it can carry a relatively heavy power tool or other heavy object including those having an angular portion, such as a power drill, soldering gun, caulking gun and the like.

In the preferred embodiment of the tool holder, the main body thereof is comprised of at least holding area having a back surface and a front surface which are specially configured to contain power tools and other heavy objects, including those having an "L" or another angular shape.

In the preferred embodiment, the specially configured pocket is placed in the area closest to the user to provide additional structural support for the tool or other object to be placed therein.

Pockets can also be specially configured to contain other tools or objects of various shapes and sizes which the prior art holders were unable safely to carry within their substantially rectangular shaped pockets.

The preferred embodiment of the tool holder also includes means for carrying many different items such as tools, writing implements, drill bits, rulers and the like, which permits the easy and relatively safe transportation of all of these various items at the same time. The present invention also offers a means of carrying many different types and sizes of such items at the same time so that they are readily accessible.

DESCRIPTION OF PREFERRED EMBODIMENTS

Figure 1:
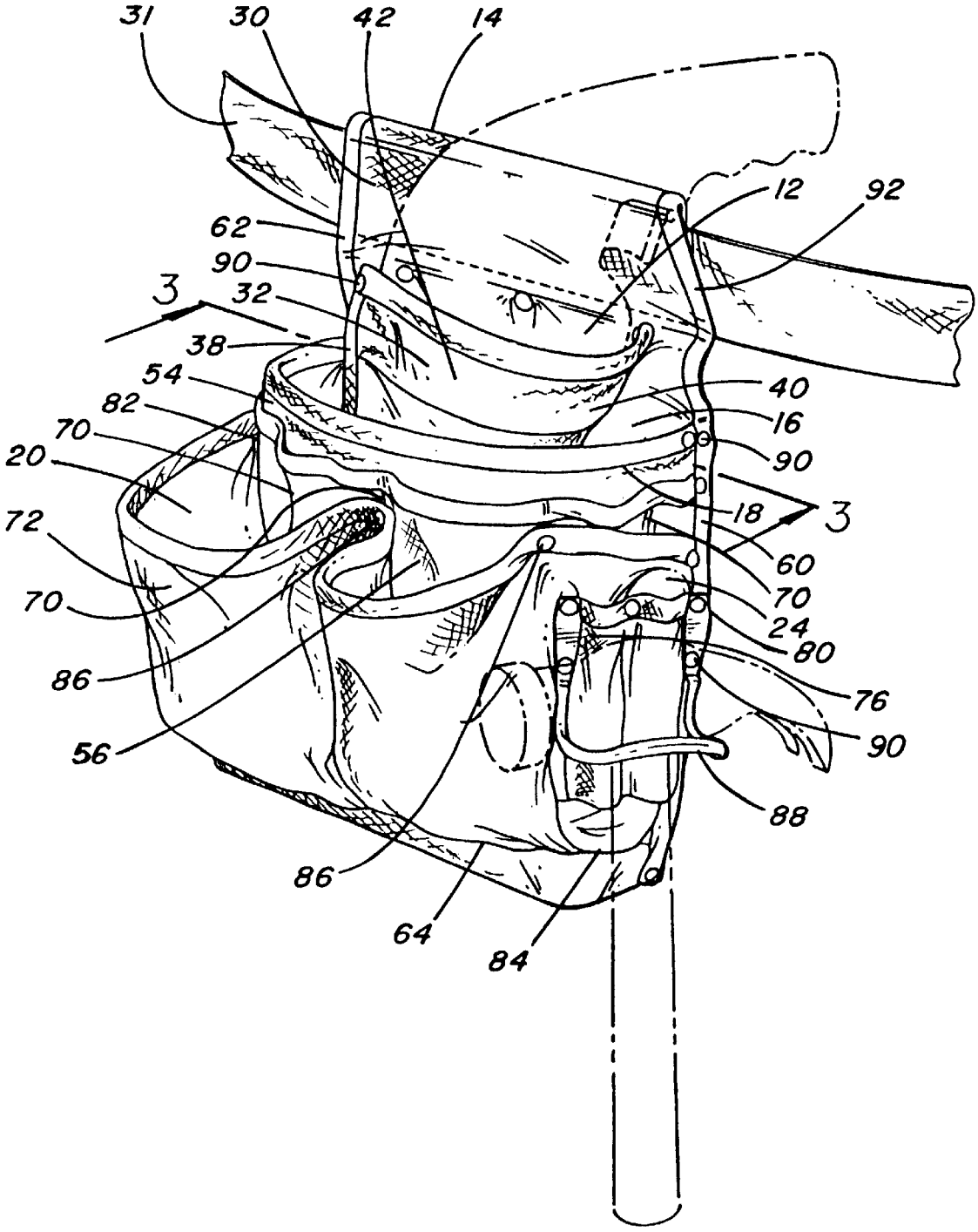
FIG. 1 is a perspective view of the front right side of the preferred embodiment of the tool holder of the present invention.
Figure 2:
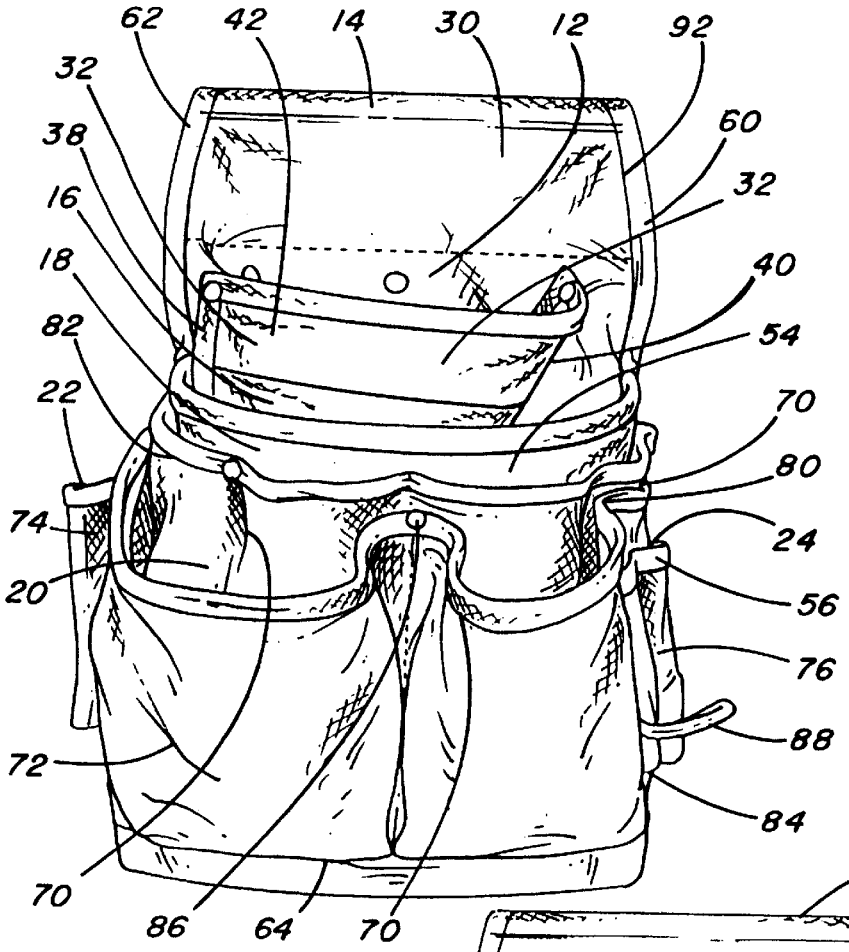
FIG. 2 is a perspective front view of the tool holder shown in FIG. 1.
Figure 3:
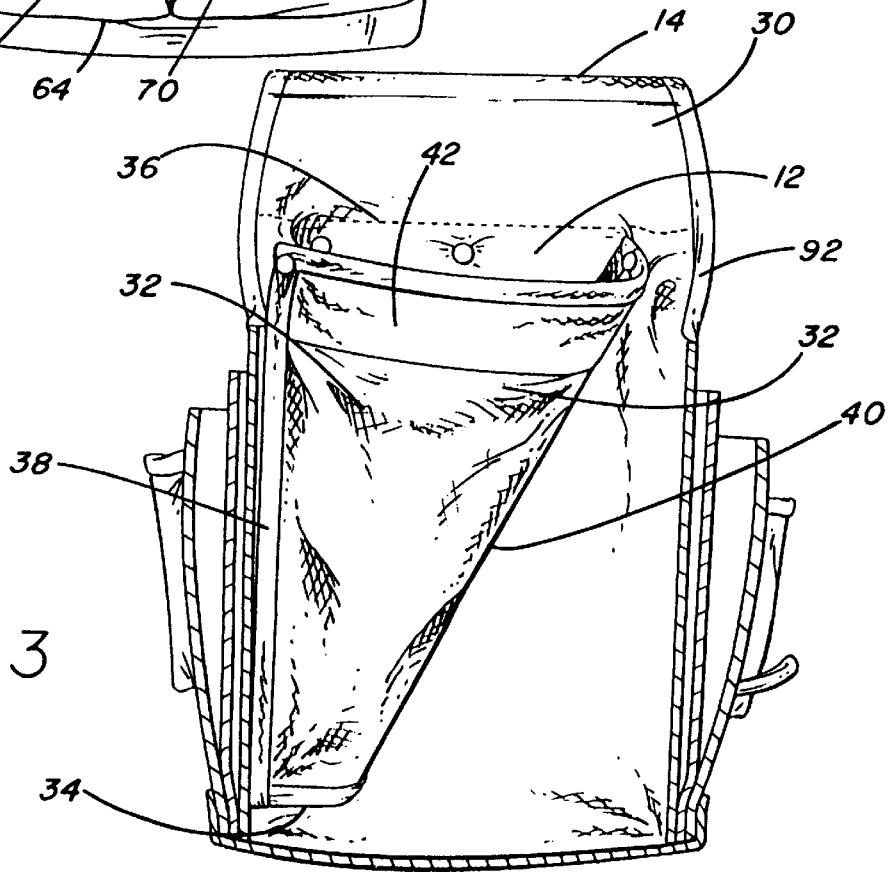
FIG. 3 is a perspective front view of the tool holder shown in FIG. 2 in which the outer pockets have been removed to show the innermost pocket of the present invention.

Referring to FIGS. 1–3, the preferred embodiment of the present invention is shown. The tool holder 10 is comprised of a first inner holding area 12, a belt attachment means 14, and a plurality of other pockets and/or holding areas 16, 18, 20, 22 and 24. Belt attachment means 14 is formed by either folding over the top portion of backing 30 and affixing it to the rear of the backing to create an elongated belt loop (not shown) through which belt 31 is threaded, by attaching a piece of hook material on the rear facing portion of the backing 30 and attaching it to a belt that is comprised of either loop material or other material that will fixedly grab onto the hook material attached to the backing 30, or by any other suitable attachment method.

The backing materials used in the present invention may be comprised of leather, Cordura or any other structurally strong material.

Holding area 12 is formed by attaching a separate piece 32 of backing material to backing 30 so as to form a bottomless pocket that is narrower at the bottom 34 (FIG. 3) than it is at the top 36 (FIG. 3). In the preferred embodiment, pocket 12 is substantially triangular in shape as shown in FIG. 3. Also in the preferred embodiment, at least one side 38 of pocket 12 is attached proximate to the first outer edge of backing 30, while the other side 40 of pocket 12 is attached substantially near the diagonal axis of backing. This is the preferred shape to carry items that are angular in shape such as power tools, soldering and caulking guns and the like. In addition, to further support the weight of the item to be placed into the pocket 12, binding 42 is attached along the upper edge of the outside of pocket 12. In the preferred embodiment, the bottom of holding area 12 is not closed.

Due to the configuration of holding area 12, an item having an angular shape, such as either an "L" or "V" shape, may be carried therein. Specifically, one of the linear portions of a substantially angular shaped item will be able to rest substantially within the holding area by laying along the diagonal edge 40 while the other linear portion extends out from the holding area 12.

In other embodiments of the invention, it is contemplated that the holding area is configured in a specific shape so as to hold a specifically configured tool or other item, so that it will not easily fall out when the holder is worn by the user. Thus, instead of a substantially diagonal seam, the holding area may be shaped like the barrel end of a soldering gun, power tool or the like.

The depth of holding area 12 is substantially deep enough to hold the functional end of a tool or other object such as an electrical drill, screwdriver, staple, nail gun or the like.

Pockets/holding areas 16, 18, 20, 22 and 24 are formed by attaching additional pieces of backing material using conventional techniques such as sewing, riveting or the like.

In the preferred embodiment, a pocket 16 is created by attaching a third substantially rectangular piece 54 of backing material that is larger than the width of backing 30 to each of the side edges 60 and 62 and the bottom edge 64 of backing 30, so that the bottom edge 64 of backing 30 and a small portion of the sides proximate the bottom edge form the bottom of pocket 16., A row of pockets 18 are formed along the outside of pocket 16 by attaching a fourth piece 56 of backing which is slightly wider than third piece 54, along the outer side and bottom edges of pocket 18 and backing 30 and by attaching the fourth piece at a plurality of spaced locations 70 along the vertical axis thereof. The number and location of the vertical attachments is dependent upon the desired number and width of the pockets to be formed in row 18.

Additional rows of pockets may be formed whose depth and width depend upon the desires of the manufacturer. In the preferred embodiment there are rows 20, 22 and 24 formed by a fifth, sixth and seventh piece 72, 74 and 76 of backing material. The fifth piece 72 is attached to the backing along each of its side edges 80 and 82 and bottom 84. It also may be attached at one or more spaced locations 86 along the vertical axis thereof depending upon the desired number and width of the pockets to be formed in row 22.

Row 24 is formed by attaching another piece of backing material at its sides to the outside of piece 70. In the preferred embodiment additional loops 88 may be added to carry tools such as hammers (as shown in FIG. 1.)

In the preferred embodiment, all of the edges of the tool pouch are reinforced to prevent fraying. Also binding 42 may be attached to the fronts of each pocket proximate the reinforced edges to provide additional structural support.

The pockets may be attached by stitching, riveting or other suitable heavy duty attachment method. In the preferred embodiment, each of the pockets are stitched at their outer edges and bottom and for extra structural support, rivets 90 are also placed proximate each end of the pocket opening the upper outer edges where the pockets are attached to the sides of backing 30.

It is also contemplated that numerous additional metal bars or other equivalent attachment means may be attached at a corresponding number of additional locations on tool holder 10.

In the preferred embodiment, all of the edges of the tool pouch are reinforced with binding 50 to prevent fraying. Also additional material 52 is attached to the fronts of each pockets to provide additional structural support.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

What is claimed is:

1. A tool holder for carrying at least one portable tool having a substantially angular shaped portion, comprising:

a first pocket comprising of front and back walls having vertical edges, wherein said first pocket is formed by connecting said front and back walls along their vertical edges such that there is an opening at the top thereof, and a second pocket affixed substantially within said first pocket, said second pocket having a front wall having a vertical edge and a substantially diagonal edge, said vertical edge of said second pocket being aligned with one of said vertical edges of said first pocket, said second pocket being formed by connecting said front wall of said second pocket to the back wall of said pocket along said vertical and substantially diagonal edges such that said vertical edge of said second pocket is secured proximate said one vertical edge of said first pocket, said second pocket having an opening at the top thereof which extends substantially across said back wall of said first pocket in a plane that is substantially parallel to the opening of said first pocket, said second pocket being larger at its opening and narrower at its bottom such that said second pocket is configured so as to accept a portion of the substantially angular shaped portable tool.

2. The tool holder of claim 1 further comprising means for attaching said tool holder to a belt to be worn around the user's body.

3. The tool holder of claim 1 further comprising first structural supporting means attached proximate the opening of said first pocket at the edge thereof and second structural supporting means attached proximate the opening of said second pocket at the upper edge thereof for providing additional structural support for said pockets.

4. The tool holder of claim 1 further comprising a plurality of other pockets in connection with said tool holder for carrying other tools and supplies.

5. The holder of claim 1, wherein said plane defined by said opening of said second pocket is than the opening defined by said first pocket.

6. The holder of claim 1, wherein said diagonal edge of said second pocket extends substantially between the other of said vertical edges of said first pocket proximate its opening and the one vertical edge of said first pocket proximate its bottom.

7. The holder of claim 1, wherein a rear wall of said second pocket is formed from a portion of the back wall of said first pocket.

* * * * *